US011464329B1

(12) United States Patent
Levy et al.

(10) Patent No.: US 11,464,329 B1
(45) Date of Patent: Oct. 11, 2022

(54) LUGGAGE RACK EXTENDER

(71) Applicants: Elizabeth Levy, Hallandale, FL (US); David Toledano, Hallandale, FL (US); Aholeab Toledano, Hallandale, FL (US)

(72) Inventors: Elizabeth Levy, Hallandale, FL (US); David Toledano, Hallandale, FL (US); Aholeab Toledano, Hallandale, FL (US)

( * ) Notice: Subject to any disclaimer, the term of this patent is extended or adjusted under 35 U.S.C. 154(b) by 0 days.

(21) Appl. No.: 17/372,003

(22) Filed: Jul. 9, 2021

(51) Int. Cl.
*A47B 43/00* (2006.01)
*A47B 81/00* (2006.01)
*A47B 61/06* (2006.01)

(52) U.S. Cl.
CPC ..... *A47B 43/00* (2013.01); *A47B 81/00* (2013.01); *A47B 61/06* (2013.01)

(58) Field of Classification Search
CPC ..... A47B 61/06; A47B 61/02; A47B 43/00; A47B 81/00; A47B 3/02; A47B 2003/045
USPC ..... 211/202, 201
See application file for complete search history.

(56) References Cited

U.S. PATENT DOCUMENTS 31,538 A * 2/1861 Frazee ..... D06F 57/10 211/202
102,717 A * 5/1870 Shryver ..... D06F 57/10 211/202
102,831 A * 5/1870 Kendrick ..... D06F 57/10 211/202
120,443 A * 10/1871 Knight ..... D06F 57/10 211/202
125,713 A * 4/1872 Ainsworth ..... D06F 57/10 211/202
264,000 A * 9/1882 Vanderlip ..... D06F 57/10 5/98.1
484,931 A * 10/1892 Hendricks ..... D06F 57/10 211/202
526,249 A * 9/1894 Meeker ..... B65D 37/00 220/9.3
660,290 A * 10/1900 Corbin ..... A47F 5/13 248/167
674,271 A * 5/1901 Knapp ..... D06F 57/10 211/202
982,477 A * 1/1911 Cavanagh ..... A47G 25/10 5/310
1,051,766 A * 1/1913 Rogers ..... D06F 57/10 211/202
1,205,205 A * 11/1916 Hoag ..... D06F 57/10 211/202
1,340,565 A * 5/1920 Seidenburg ..... A47B 61/06 312/200

(Continued)

*Primary Examiner* — Stanton L Krycinski
(74) *Attorney, Agent, or Firm* — Sanchelima & Associates, P.A.; Christian Sanchelima; Jesus Sanchelima

(57) ABSTRACT

A luggage rack extender includes a frame assembly, an extender assembly, and a folding assembly. The frame assembly includes a cross shaped frame with an operative top end. The extender assembly includes an outer rod mounted on the operative top end with an inner bar extending normally from opposing distal ends of the outer rod. The folding assembly includes a first outer bar and a second outer bar that are operatively engaged adjacently to the inner bars of the extender assembly. The extender assembly is slidably actuated from the folding assembly to enable an extended frame configuration.

13 Claims, 10 Drawing Sheets

(56) References Cited

U.S. PATENT DOCUMENTS 1,894,176 A * 1/1933 Hirsch ..... A47B 43/00 211/198
2,356,930 A * 8/1944 Horstkotte ..... D06F 57/08 211/170
2,417,387 A * 3/1947 Totty ..... A47B 61/06 312/321
2,557,594 A * 6/1951 Bryan ..... A47B 3/02 108/118
2,558,995 A * 7/1951 Tullis ..... A47C 4/283 108/14
2,623,755 A * 12/1952 Terry ..... B62B 3/022 211/202
2,948,410 A * 8/1960 Maddox ..... A47G 25/0664 108/118
3,133,645 A * 5/1964 Cecil ..... D06F 57/10 211/202
4,111,309 A * 9/1978 Henry ..... A47B 61/02 211/180
4,131,205 A * 12/1978 Malecki ..... D06F 57/10 211/202
4,807,766 A * 2/1989 Compagnucci ..... D06F 57/08 211/198
4,823,965 A * 4/1989 Hughes ..... F24B 1/199 211/49.1
5,016,367 A 5/1991 Breen
5,033,758 A * 7/1991 Levy ..... B62B 3/02 248/419
5,123,665 A * 6/1992 Levy ..... B62B 3/022 280/659
5,146,635 A * 9/1992 Gastie ..... A61D 3/00 119/757
5,190,254 A * 3/1993 Maguire ..... F16M 11/245 248/164
5,213,221 A * 5/1993 Raye, Sr. ..... D06F 57/08 211/195
5,772,233 A * 6/1998 Papendick ..... B05B 13/0285 280/638
5,879,021 A * 3/1999 Papendick ..... B05B 13/0285 280/638
5,934,641 A * 8/1999 Vince ..... A47D 9/02 248/431
6,240,987 B1 * 6/2001 Birkeland ..... B25H 1/04 144/286.5
6,443,321 B1 * 9/2002 Felsenthal ..... A47G 25/0664 211/195
6,722,293 B2 * 4/2004 Lee ..... A47B 3/02 108/118
6,814,333 B1 * 11/2004 Freiburger ..... F16M 11/38 248/164
7,168,666 B2 * 1/2007 Tucker ..... B25H 1/06 248/150
8,100,274 B2 * 1/2012 Trowsdale ..... D06F 57/08 211/195
8,950,343 B2 * 2/2015 Huang ..... A47B 3/02 108/118
9,427,849 B2 * 8/2016 McMillan ..... B25B 5/04
D822,992 S * 7/2018 Berger ..... D3/274
10,035,447 B2 7/2018 Miles
10,278,468 B2 * 5/2019 Pelatti ..... A45C 13/03
10,993,554 B2 * 5/2021 Carter ..... A47F 5/16
11,116,313 B2 * 9/2021 Leung ..... A47B 43/00
11,173,936 B1 * 11/2021 Regev ..... B62B 3/007
2009/0184117 A1 * 7/2009 Wang ..... D06F 95/004 220/9.2

* cited by examiner

LUGGAGE RACK EXTENDER

II. BACKGROUND OF THE INVENTION

1. Field of the Invention

The present invention relates to luggage rack extender and, more particularly, to a luggage rack extender that includes a folding assembly and an extender assembly engaged with the folding assembly that can be actuated to extend an outer frame in order to support a luggage article.

2. Description of the Related Art

Several designs for luggage platforms have been designed in the past. None of them, however, include a luggage rack extender including a frame assembly, a extender assembly, and a folding assembly. The frame assembly includes a cross shaped frame with an operative top end. The extender assembly includes an outer rod mounted on the operative top end with an inner bar extending normally from opposing distal ends of the outer rod. The folding assembly includes a first outer bar and a second outer bar that are operatively engaged adjacently to the inner bars of the extender assembly. The extender assembly is slidably actuated from the folding assembly to enable an extended frame configuration.

It is known that luggage often has an opened butterfly configuration with two halves. Often a user needs a platform to support both halves of the luggage. However, some platforms to not have the surface area needed to support the luggage in the opened configuration. Therefore there is a need for a luggage rack extender to provide an extended configuration to provide the surface area and support necessary to support the luggage in an opened configuration and can be discretely stored.

Applicant believes that a related reference corresponds to U.S. Pat. No. 5,016,367 issued for an ironing board that includes a main board and two swingable board extensions retractable attached to the main board. Applicant believes that another related reference corresponds to U.S. Pat. No. 10,035,447 issued for an elevating storage apparatus for storing an article or articles in an elevated position. However, the cited references differ from the present invention because they fail to disclose a luggage rack extender comprising an extender assembly and a folding assembly to enable from a platform which can be actuated to provide and extended configuration and can be foldably actuated in order to provide a stored configuration for the extender.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a luggage rack extender that provides an extended platform to support a luggage in an opened configuration with two halves being entirely supported on the platform.

It is another object of this invention to provide a luggage rack extender which provides a foldable configuration that allows a user to discretely store the luggage rack extender.

It is still another object of the present invention to provide a luggage rack extender that can be selectively engaged in a normal and extended configuration in order to support different variations of luggage.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 3:
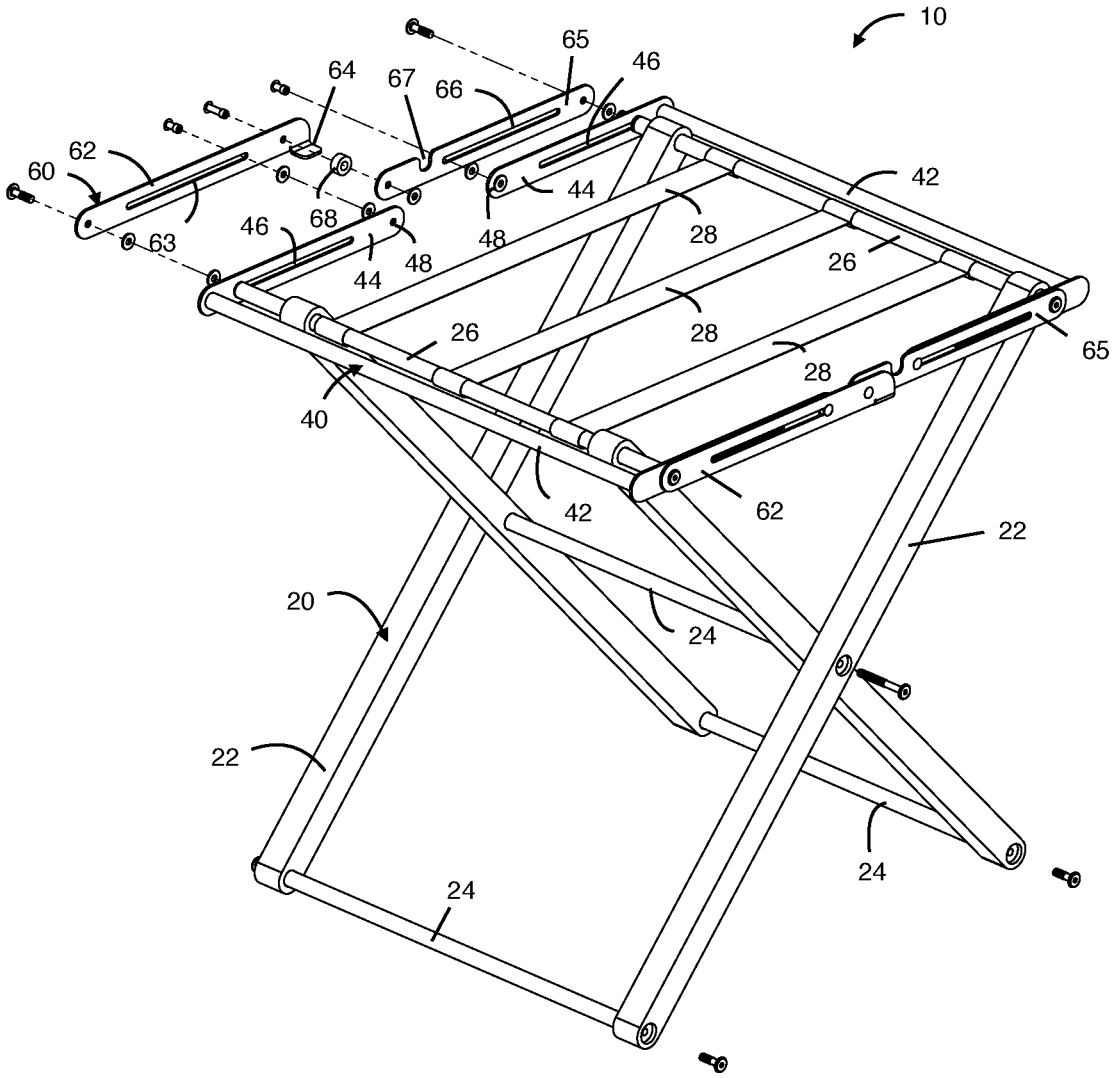

FIG. 3 illustrates an exploded view of luggage rack extender 10 depicting folding assembly 60 being exploded from the extender assembly 40 in accordance with an embodiment of the present invention.

Figure 4:
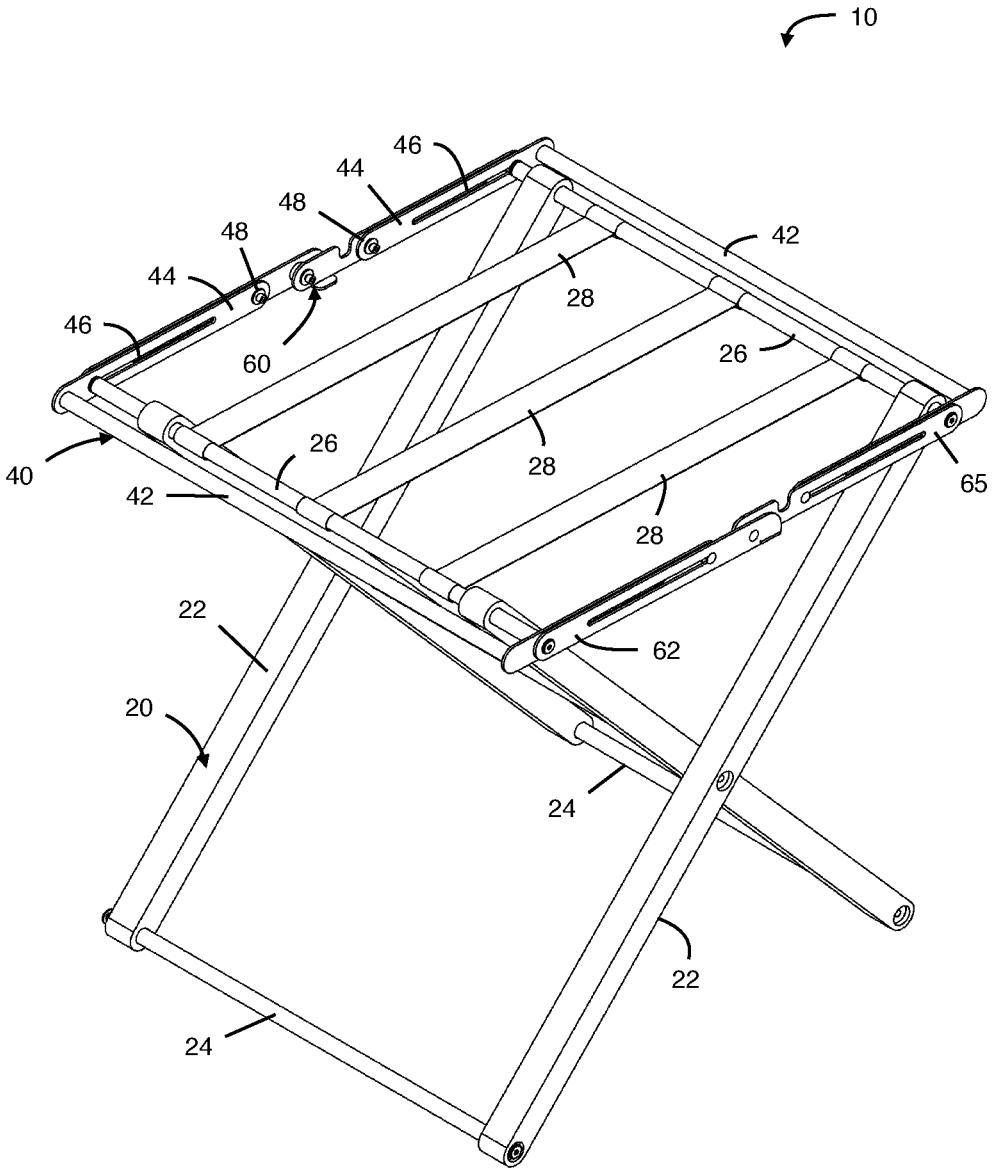

FIG. 4 is a representation of an isometric view of luggage rack extender 10 in a normal configuration in accordance with an embodiment of the present invention.

Figure 5:
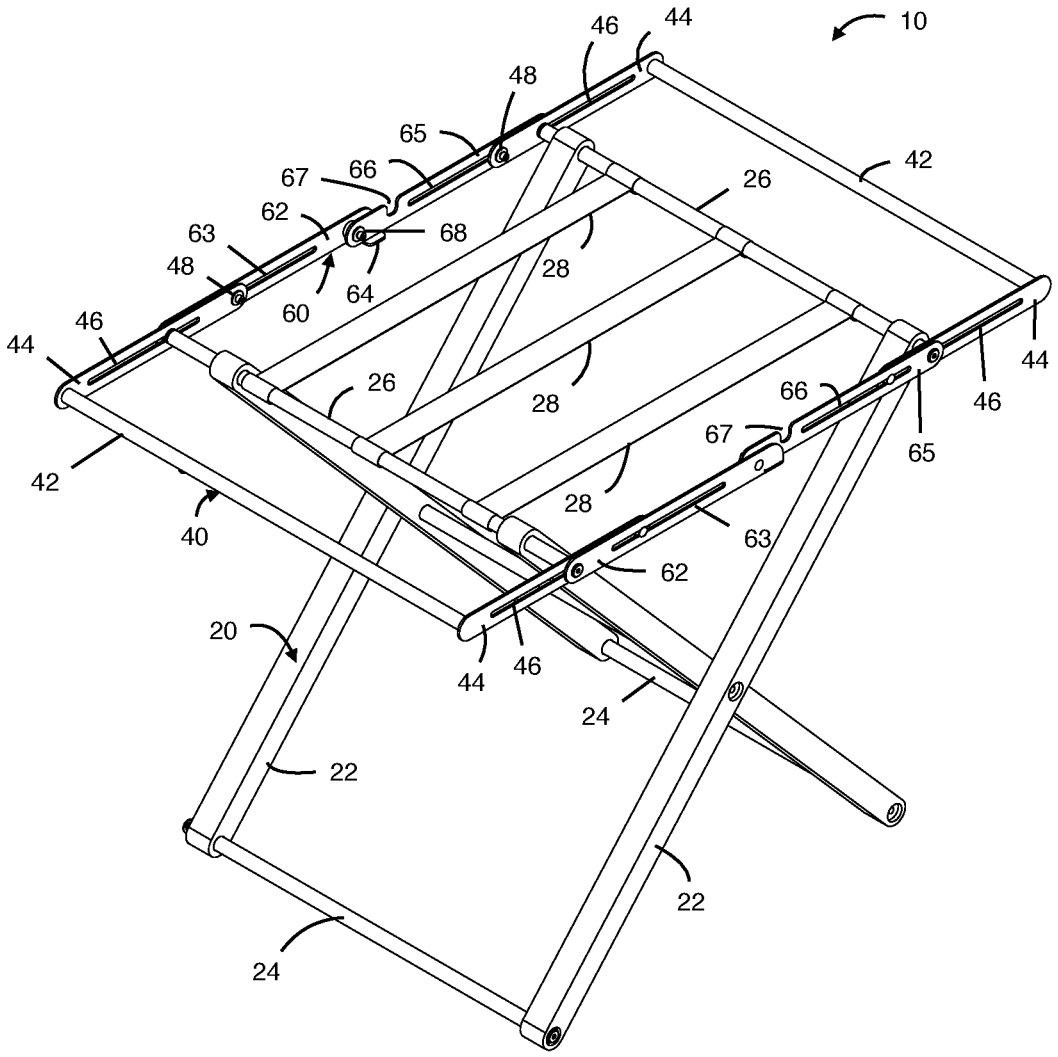

FIG. 5 shows an isometric view of luggage rack 10 extender in an extended configuration in accordance with an embodiment of the present invention.

Figure 6:
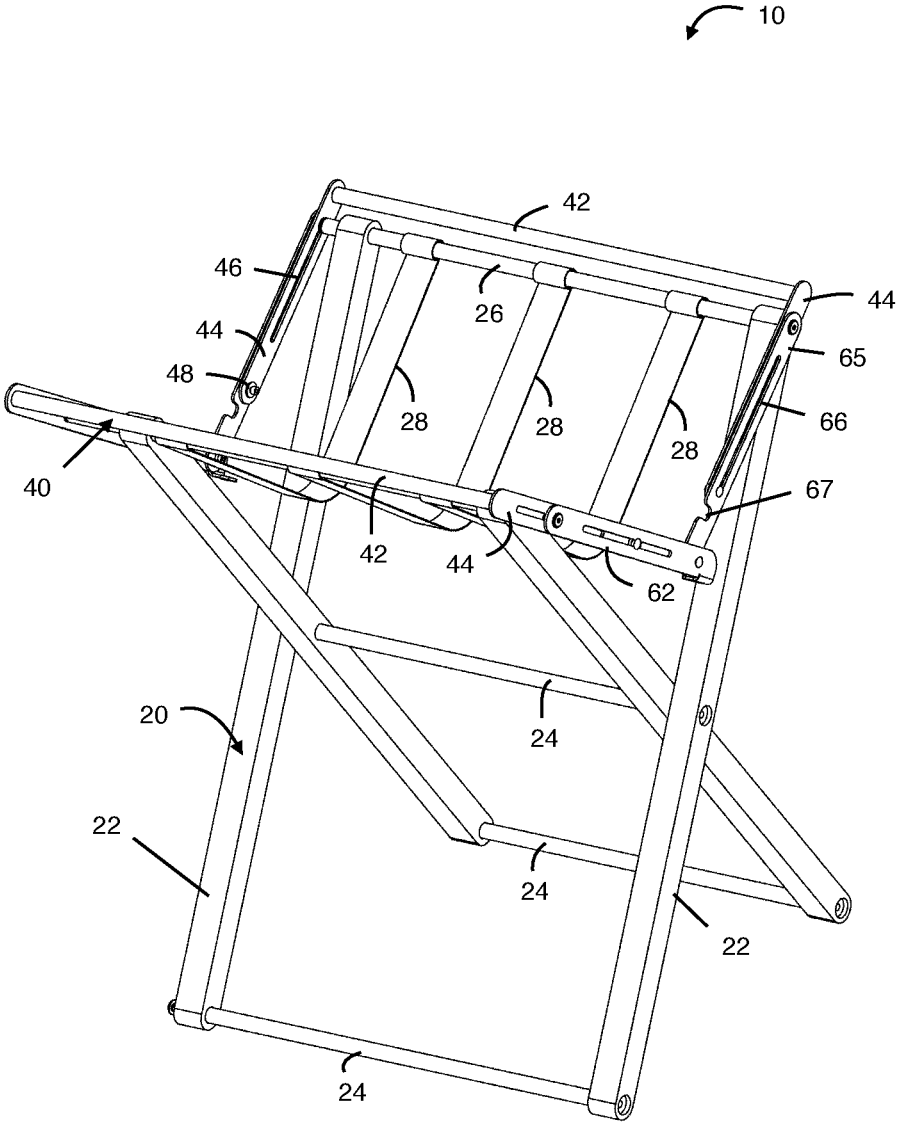

FIG. 6 illustrates an isometric view of luggage rack extender 10 in a partially folded configuration in accordance with an embodiment of the present invention.

Figure 7:
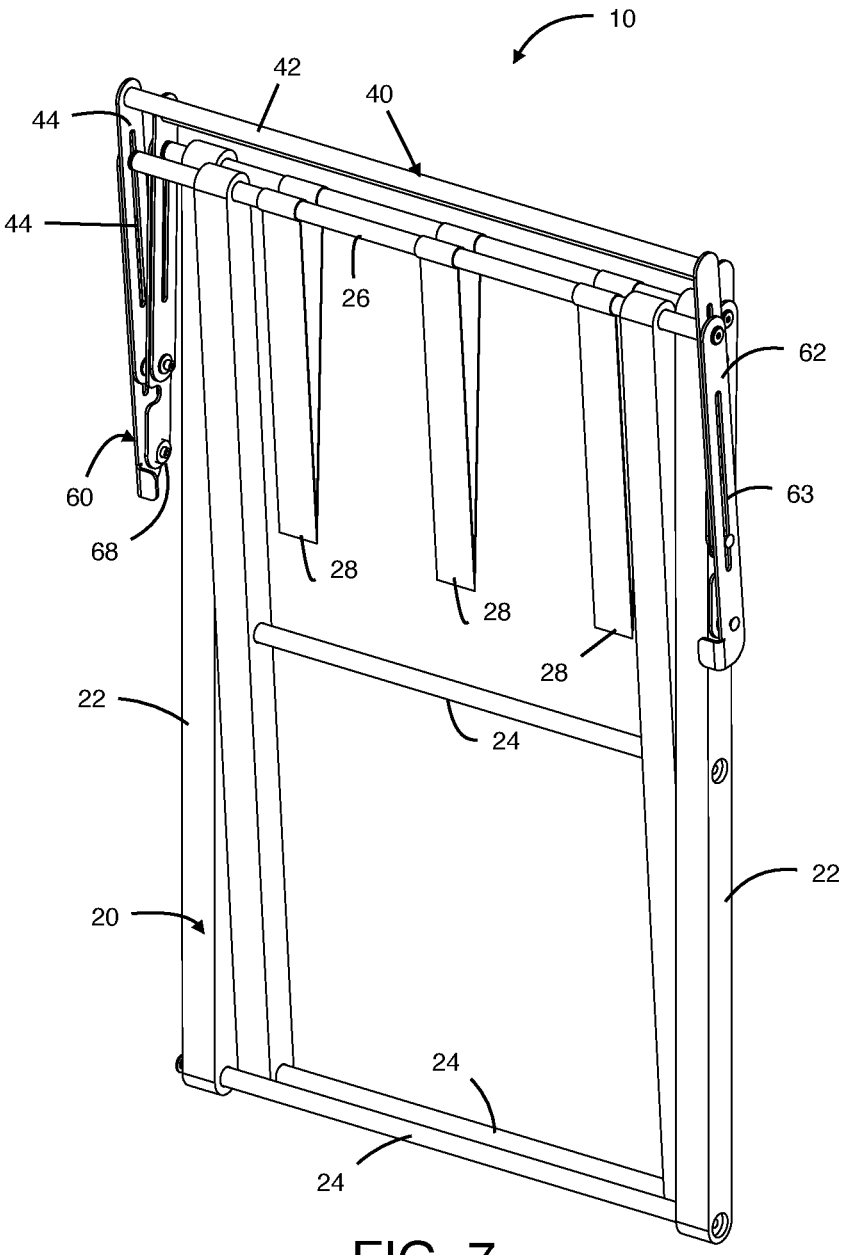

FIG. 7 represents an isometric view of luggage rack extender 10 in a fully folded configuration in accordance with an embodiment of the present invention.

Figure 8:
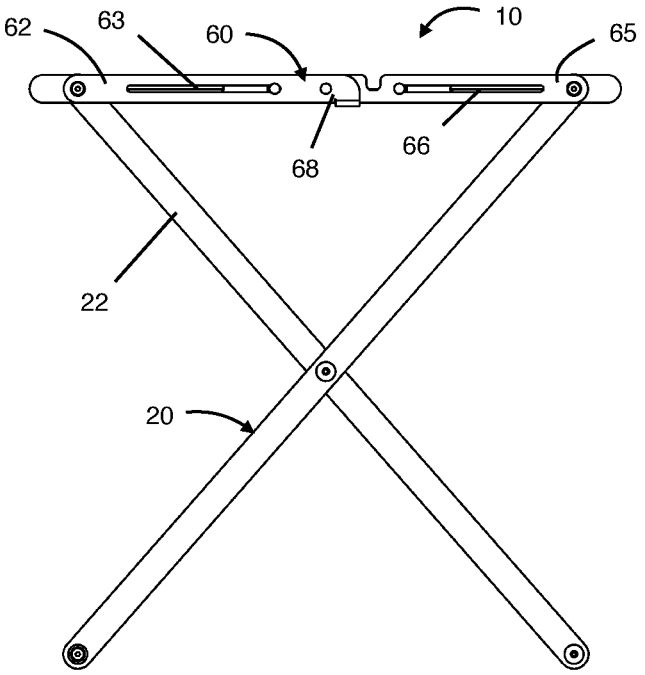

FIG. 8 shows a side plan view of luggage rack 10 extender in a normal configuration in accordance with an embodiment of the present invention.

Figure 9:
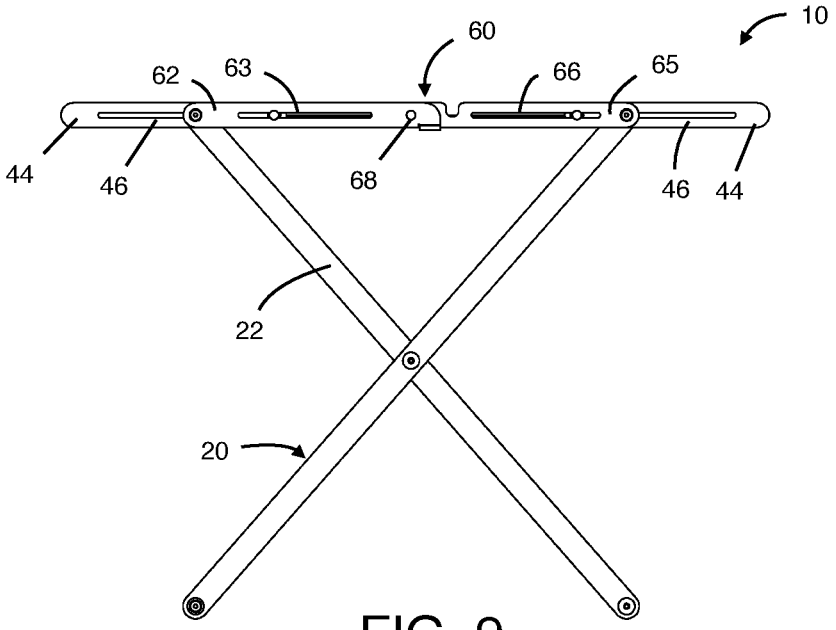

FIG. 9 illustrates another side plan view of luggage rack extender 10 in an extended configuration in accordance with an embodiment of the present invention.

Figure 10:
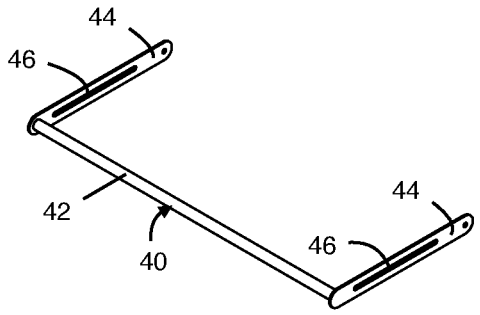

FIG. 10 is a representation of an isometric view of extender assembly 40 in accordance with an embodiment of the present invention.

Figure 11:
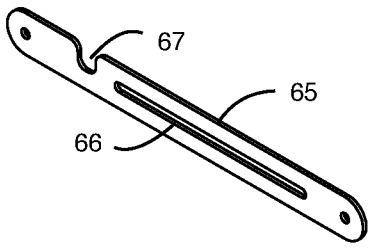

FIG. 11 shows an isometric view of the second outer bar of the folding assembly 60 in accordance with an embodiment of the present invention.

Figure 12:
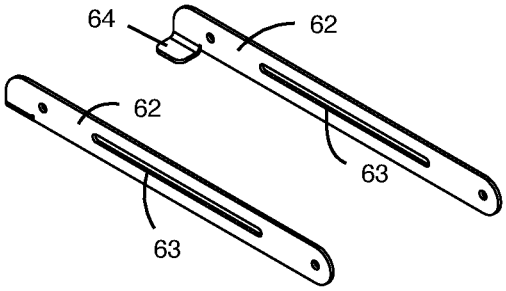

FIG. 12 illustrates an isometric view of the first outer bar of the folding assembly 60 in accordance with an embodiment of the present invention.

Figure 13:
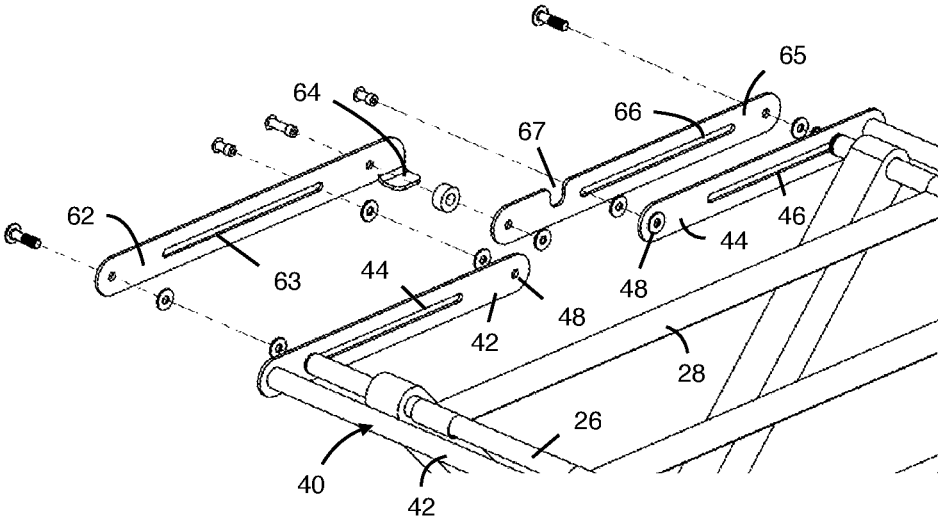

FIG. 13 provides an enlarged isometric view of the extender assembly 40 and the folding assembly 60 in accordance with an embodiment of the present invention.

V. DETAILED DESCRIPTION OF THE EMBODIMENTS OF THE INVENTION

Referring now to the drawings, where the present invention is generally referred to with numeral 10, it can be observed a luggage rack extender 10 which basically includes a frame assembly 20, an extender assembly 40, and a folding assembly 60.

Frame assembly 20 can be properly observed in FIG. 3 of the provided drawings. Frame assembly 20 includes at least two cross members 22. In the present embodiment, cross members 22 are provided as cross shaped structural members that are foldable along a center axis. Additionally, the at least two cross members 22 are positioned parallel to each other and are aligned such that each axis of the cross members are also parallel to each other. Each of the at least two cross members are then joined together with support bars 24. In the present embodiment, support bars 24 can be provided as structural rod members that extend normally therefrom lateral side ends of the cross members 22. In one implementation, support bars 24 can be disposed along various sections of the cross members 22. In one embodiment, support bars 24 are disposed along the operative bottom end of the cross shaped members 22 in order to provide a base support to support the cross members 22 on a ground surface. Furthermore, a support bar 24 may also be disposed along a center of the cross member 22 in operative engagement with the center axis of the cross members 22.

Frame assembly 20 further includes top bars 26 which are disposed on the operative top end of the cross members 22. In one embodiment, cross members 22 are provided as being parallel to each other and joined to the top distal ends of the cross members 22. Furthermore, as observed in the figures, top bars 26 have a length which is substantially longer that the length of support bars 24. As observed, top bars 26 comprise a length such that they extend outwardly from the sides of the cross shaped members 22. This configuration will be important in order to receive the extender assembly 40. Frame assembly further includes cloth strips 28 that are disposed on the operative top end of the cross members 22. In one embodiment, cloth strips 28 are engaged to the top bars 26 and extend in a normal configuration therefrom. The present implementation can feature a plurality of cloth strips 28 secured thereon in a parallel configuration to each other. This configuration results in a platform formed on the operative top end of the frame assembly 20 which can support an article thereon.

Extender assembly 40 can be properly observed in FIGS. 3 and 10 of the provided drawings. Extender assembly 40 includes an outer rod 42 disposed on the operative top end of the frame assembly 20. In one embodiment, outer rod 42 can be provided as a cylindrical rod member with a first end and a second end. In the present embodiment, the outer rod 42 has a length that is equal to a length of the top bars 26 of the frame assembly 20. As observed in the drawings, an outer rod 42 is provided for each of the tow top bars 26 engaged on the operative top end of the frame assembly 20. Outer rod 42 further includes an inner bar 44 that is operatively engaged to each of the first end and the second end of the outer rod 42. In the present embodiment, the inner bar 44 of the first and second end are provided to be in a parallel configuration to each other and, as such, extend in a normal configuration from the outer rod 42. In the present implementation, the outer rod 42 is disposed adjacent to the top bar 26 of the operative top end of the frame assembly 20. The outer rod 42 is positioned such that the outer rod 42 is the outer most rod on the lateral side of the operative top end of the frame assembly. The inner bars 44 are disposed such that they extend inwardly along the outer frame of the operative top end of the frame assembly 20.

As observed in FIG. 3, each of the inner bars 44 are operatively coupled to the top bars 26 of the frame assembly 20. Each of the inner bars 44 includes a first operative end and a second operative end. An inner bar slit 46 is then formed entirely between the first operative end and the second operative end of the inner bar 44. The first operative end is coupled to the outer rod 42 and extends normally therefrom. The second outer end includes a mounting end 48 which is then engaged with the folding assembly 60. A distal most end of the top bar 26 is then operatively engaged within the inner bar slit 46 of the inner bars 44. In the present implementation, top bar 26 must be operatively secured within the inner bar slit 46 such that the distal most end of the top bar 26 is slidable entirely along the inner bar slit 46. FIG. 5 depicts the embodiment of the top bar 26 slidably engaged with the inner bar slit 46 of the inner bar 44. In the present implementation the extender assembly 40 is disposed adjacent to each of the two top bars 26 of the operative top end of the frame assembly 20. As observed in FIG. 3, the inner bars 44 extend inwardly along the outer frame of the operative top end. However, the opposing inner bars 44 of the operative top end are not engaged with each other when secured to the top bars 26.

Folding assembly 60 can be observed in FIGS. 3, 11, and 12 of the provided figures. In the present implementation, folding assembly 60 serves to enable the frame assembly 20 to have a folded configuration and an extended configuration. Folding assembly 60 includes a first outer bar 62 and a second outer bar 65 each having a first operative end and a second operative end. In the present implementation, frame assembly 20 includes opposing lateral sides, with each lateral side having a first outer bar 62 and a second outer bar 65 operatively engage thereon to form an outer frame for the operative top end of the frame assembly 20. As observed in FIG. 3, the first operative end of the first outer bar 62 is securely engaged with one of the top bars 26 of the operative top end of the frame assembly 20. Furthermore, the second operative end of the first outer bar 62 is then mounted to the second outer bar 65. A first outer bar slit 63 is disposed entirely between the first operative end and the second operative end of the first outer bar 62. In the present implementation, the first outer bar slit 63 is aligned with the inner bar slit 46 of the inner bar 44. The mounting point 48 of the inner bar 44 is then slidably secured to the first outer bar slit 63 of the first outer bar. As a result, mounting point 48 can be slidably translated along the first outer bar slit 63. First outer bar 62 further includes a stopper 64 operatively disposed at the second operative end thereof. In the present embodiment, stopper 64 is a rectangular structural member that is provided integral to the operative second end. The stopper 64 extends normally from the second operative end at a bottom edge to provide support.

In the present embodiment, the second outer bar 65 includes a first operative end and a second operative end with a second outer bar slit 66 located entirely between the first operative end and the second operative end. In the present embodiment, the first operative end of the second outer bar 65 is operatively coupled to the second operative end of the first outer bar 62 in order to form a joint 68 such that the first outer bar and the second outer bar are foldable with respect to each other. In the present embodiment, the first operative end of the second outer bar 65 is supported on the stopper 64 of the first outer bar 62. The stopper 64 allows the second outer bar 65 to rest thereon in order to prevent the first and second outer bar to fold beyond a desired amount. In the present implementation, the second operative end of the second outer bar 65 is mounted to the opposing top bar 26 of the operative top end of the frame assembly. Furthermore, the second outer bar slit 66 is then aligned with the inner bar slit of the opposing top bar 26. The mounting section 48 of the opposing top bar is then slidably engaged with the second outer bar slit 66 of the second outer bar 65.

The second outer bar 65 further includes a cut portion 67 formed at the first operative end thereof. In the present embodiment, the cut portion 67 is a c-shaped cut portion formed along the top edge. The cut portion 67 is provided in order to prevent the frame assembly 20 to be folded further than a desired amount. FIGS. 6 and 7 depict the frame assembly 20 in a folded configuration. The frame assembly 20 in FIG. 6 is depicted in a partially folded configuration with the first outer bar 62 and the second outer bar 65 in an actuated configuration forming a V-shape. FIG. 7 depicts a fully folded configuration with the frame assembly 20 being generally flat allowing the frame assembly to be stored in a variety of spaces. As observed the first outer bar 62 and the second outer bar 65 are fully aligned with each other in an upright configuration.

Figure 1:
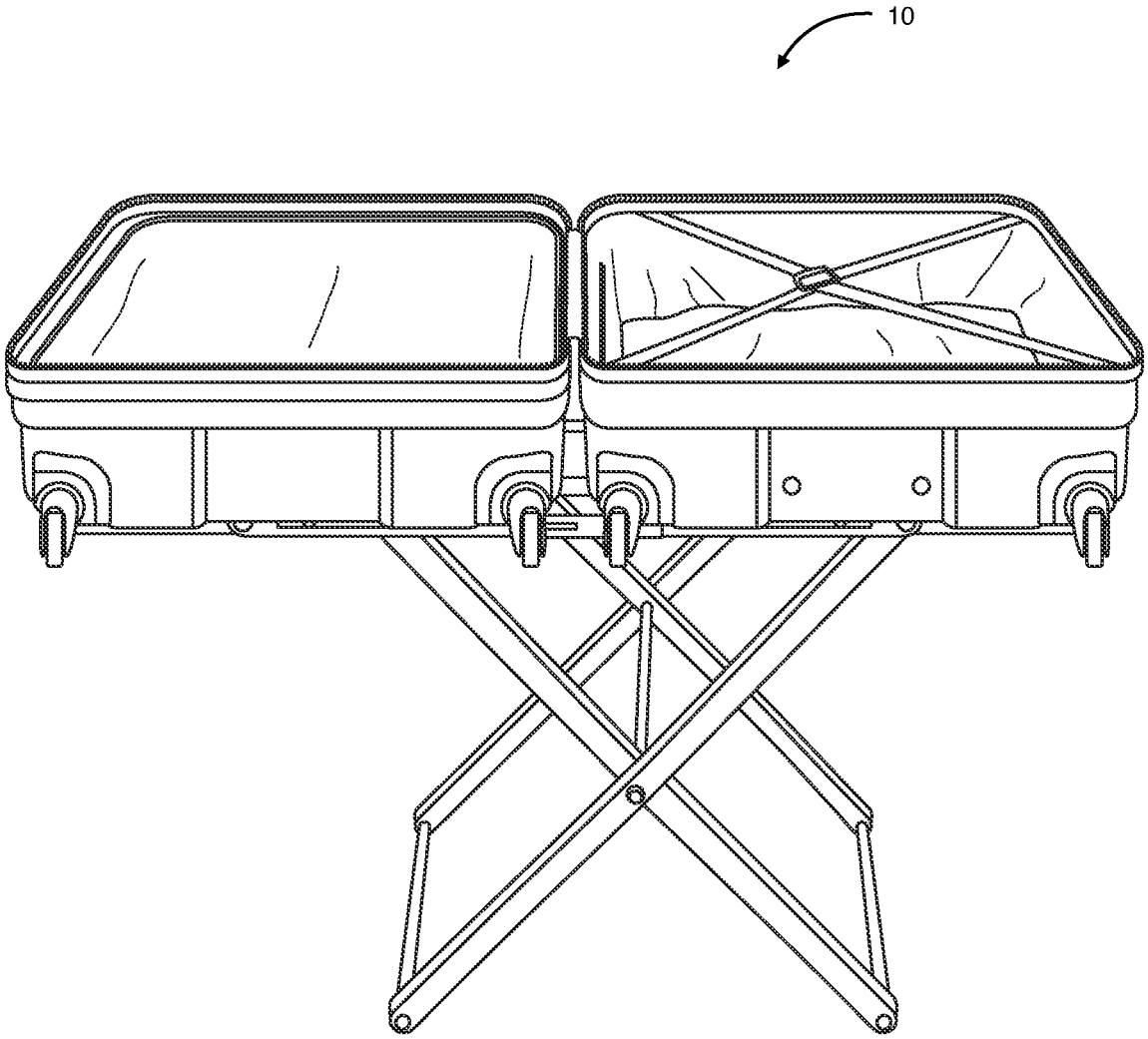
FIG. 1 represents an operative front view depicting a luggage in an opened configuration being supported on the luggage rack extender 10 in accordance with an embodiment of the present invention.
Figure 2:
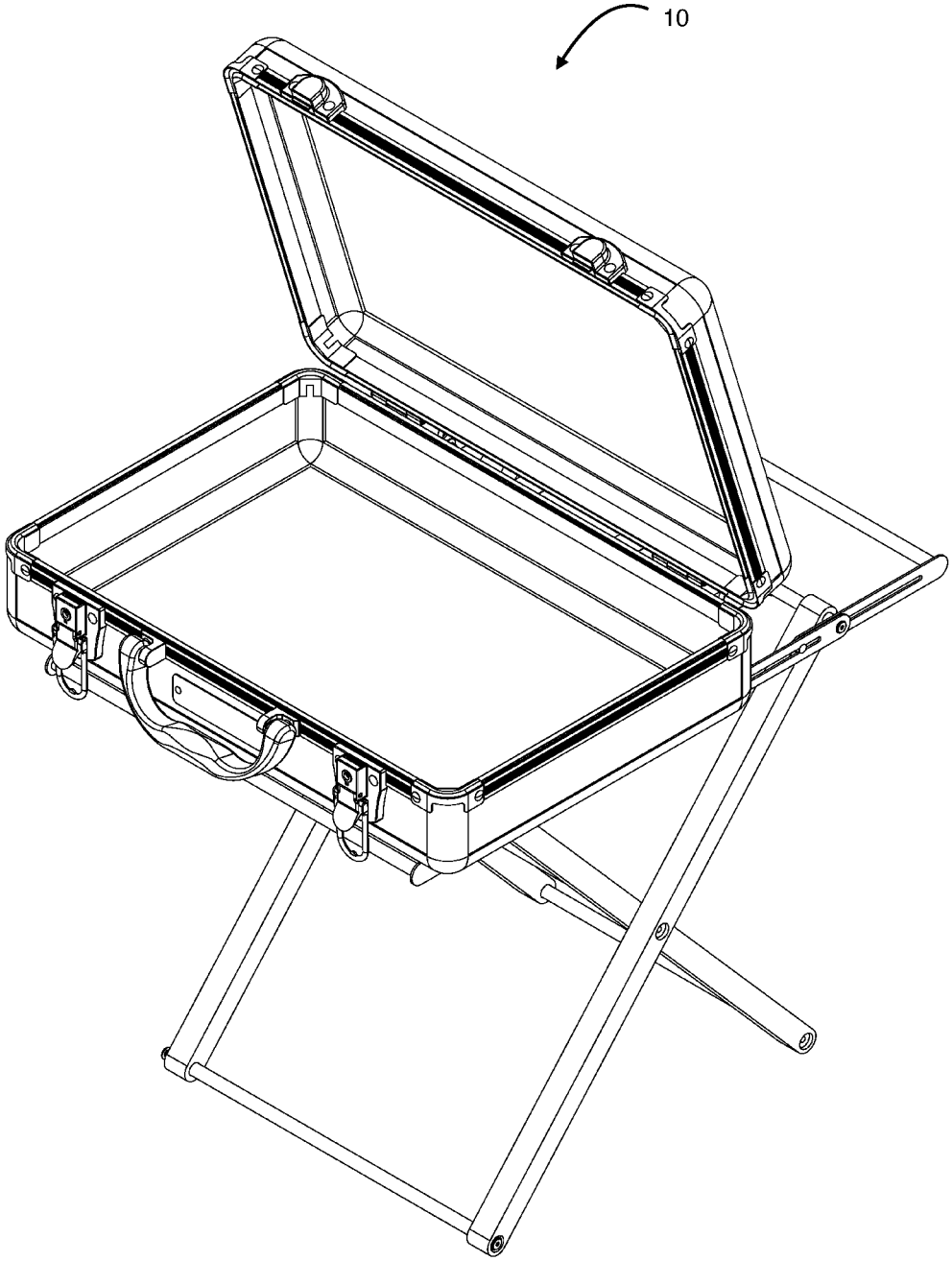
FIG. 2 shows an operative isometric view of a luggage in a partially opened configuration being supported on the luggage rack extender 10 in accordance with an embodiment of the present invention.

In the present embodiment, the assembled configuration of the extender assembly 40 and the folding assembly 60 allows for the luggage rack extender 10 to have an extended configuration and a retracted configuration. The retracted configuration can be observed in FIG. 4 of the provided drawings. The extended configuration can be observed in FIG. 5 of the provide drawings. In can be observed that in the retracted configuration, the outer rod 42 remains adjacent to the top bar 26 and the mounting section 48 of the inner bar 44 remains disposed along the outer slits of the first and second outer bar. A user may then actuate the outer rods 42 in order to extend them to provide additional structural support to the operative top end of the frame assembly. Once actuated, the mounting section 48 of the inner bar 44 is translated along the outer slit of the first and second outer bar, simultaneously the inner bar 44 is translated along the distal end of the top bar 26. This actuation results in the outer frame of the operative top end of the frame assembly 20 to be extended as depicted in FIG. 5. In the extended configuration, the operative top end of the frame assembly 20 can support luggage of large volume that open into a butterfly configuration as observed in FIG. 1 of the provided drawings. The present invention provides the benefit of having a discretely storable support platform that can be utilized to support luggage.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a luggage rack extender, comprising:

a) a frame assembly including a cross frame having an operative top end, said frame assembly including opposing top bars disposed on the operative top end;

b) an extender assembly including an outer rod positioned adjacent to each of the opposing top bars, each outer rod including an inner bar extending normally from opposing distal ends thereof, wherein each inner bar includes an inner bar slit that operatively receives a distal end of a respective one of the opposing top bars; and c) a folding assembly including a first outer bar and a second outer bar mounted adjacently to the extender assembly, wherein the first outer bar and the second outer bar are foldably joined at a joint, each of the first outer bar and second outer bar including an outer slit that is operatively secured to a mounting end of a respective one of the inner bars to enable the inner bar to be slidably translated along the outer slit.

2. The system for a luggage rack extender of claim 1 wherein the frame assembly further includes support bars mounted to the cross frame, wherein the support bars extend normally from an inner side of the cross frame configured to provide structural support.

3. The system for a luggage rack extender of claim 2 wherein the support bars are disposed along an operative bottom end for the frame assembly configured to provide structural support on a ground surface.

4. The system for a luggage rack extender of claim 3 wherein one of the support bars are in operative engagement with the center axis of the cross frame.

5. The system for a luggage rack extender of claim 1 wherein the operative top end of the frame assembly further includes cloth strips engaged with the opposing top bars, said opposing top bars being parallel, wherein the cloth strips are disposed parallel to each other to form a platform on the operative top end.

6. The system for a luggage rack extender of claim 1 wherein each inner bar includes a first inner bar operative end and a second inner bar operative end, wherein the inner bar slit is entirely disposed between the first inner bar operative end and the second inner bar operative end, wherein the first inner bar operative end is mounted to the respective outer rod.

7. The system for a luggage rack extender of claim 6 wherein the mounting end of the inner bar is disposed at the second inner bar operative end of the inner bar, wherein the mounting end is aligned with the outer slit, wherein said mounting end receives a mounting fastener.

8. The system for a luggage rack extender of claim 1 wherein the first outer bar includes a first operative end and a second operative end, wherein the first operative end is engaged to one of the opposing top bars, said opposing top bars being parallel.

9. The system for a luggage rack extender of claim 8 wherein the first outer bar includes a stopper disposed at the second operative end, wherein the stopper is a rectangular structural member integral to the first outer bar.

10. The system for a luggage rack extender of claim 9 wherein the second outer bar includes a first operative end and a second operative end, wherein the first operative end of the second outer bar is engaged with one of the opposing top bars.

11. The system for a luggage rack extender of claim 10 wherein the second outer bar includes a cut portion formed at the first operative end thereof, wherein the cut portion is a c-shaped cut portion formed on a top edge of the second outer bar.

12. A system for a luggage rack extender, comprising:

a) a frame assembly including a cross frame having an operative top end, said frame assembly including opposing parallel top bars disposed on the operative top end;

b) an extender assembly including an outer rod positioned adjacent to each of the opposing parallel top bars, each outer rod including an inner bar extending normally from opposing distal ends thereof, wherein each inner bar includes an inner bar slit that operatively receives a distal end of a respective one of the opposing parallel top bars; and c) a folding assembly including a first outer bar and a second outer bar mounted adjacently to the extender assembly, wherein the first outer bar and the second outer bar are foldably joined at a joint, each of the first outer bar and second outer bar including an outer slit that is operatively secured to a mounting end of a respective one of the inner bars to enable the inner bar to be slidably translated along the outer slit, wherein the first outer bar includes a first operative end and a second operative end, wherein the first operative end is engaged to one of the opposing parallel top bars, wherein the first outer bar includes a stopper disposed at the second operative end, wherein the stopper is a rectangular structural member integral to the first outer bar, wherein the second outer bar includes a first operative end and a second operative end, wherein the first operative end of the second outer bar is engaged with one of the opposing parallel top bars, wherein the second outer bar includes a cut portion formed at the first operative end thereof, wherein the cut portion is a c-shaped cut portion formed on a top edge of the second outer bar.

13. A system for a luggage rack extender, consisting of:

a) a frame assembly including a cross frame having an operative top end, said frame assembly including opposing parallel top bars disposed on the operative top end, wherein the frame assembly further includes support bars mounted to the cross frame, wherein the support bars extend normally from an inner side of the cross frame configured to provide structural support, wherein the support bars are disposed along an operative bottom end for the frame assembly configured to provide structural support on a ground surface, wherein one of the support bars are in operative engagement with the center axis of the cross frame, wherein the operative top end of the frame assembly further includes cloth strips engaged with the opposing parallel top bars, wherein the cloth strips are disposed parallel to each other to form a platform on the operative top end;

b) an extender assembly including an outer rod positioned adjacent to each of the opposing parallel top bars, each outer rod including an inner bar extending normally from opposing distal ends thereof, wherein each inner bar includes an inner bar slit that operatively receives a distal end of a respective one of the opposing parallel top bars, wherein each inner bar includes a first inner bar operative end and a second inner bar operative end, wherein the inner bar slit is entirely disposed between the first inner bar operative end and the second inner bar operative end, wherein the first inner bar operative end is mounted to the respective outer rod, wherein the mounting end of the inner bar is disposed at the second inner bar operative end of the inner bar, wherein the mounting end is aligned with the outer slit, wherein said mounting end receives a mounting fastener; and c) a folding assembly including a first outer bar and a second outer bar mounted adjacently to the extender assembly, wherein the first outer bar and the second outer bar are foldably joined at a joint, each of the first outer bar and second outer bar including an outer slit that is operatively secured to a mounting end of a respective one of the inner bars to enable the inner bar to be slidably translated along the outer slit, wherein the first outer bar includes a first operative end and a second operative end, wherein the first operative end is engaged to one of the opposing parallel top bars, wherein the first outer bar includes a stopper disposed at the second operative end, wherein the stopper is a rectangular structural member integral to the first outer bar, wherein the second outer bar includes a first operative end and a second operative end, wherein the first operative end of the second outer bar is engaged with one of the opposing parallel top bars, wherein the second outer bar includes a cut portion formed at the first operative end thereof, wherein the cut portion is a c-shaped cut portion formed on a top edge of the second outer bar.

* * * * *